US007082719B2

(12) United States Patent
Regnery

(10) Patent No.: US 7,082,719 B2
(45) Date of Patent: Aug. 1, 2006

(54) SHUTTER BLIND

(76) Inventor: Fred Regnery, 268 Stonegate Rd., Clarendon Hills, IL (US) 60514-1033

( * ) Notice: Subject to any disclaimer, the term of this patent is extended or adjusted under 35 U.S.C. 154(b) by 118 days.

(21) Appl. No.: 10/760,912

(22) Filed: Jan. 20, 2004

(65) Prior Publication Data

US 2004/0226221 A1 Nov. 18, 2004

Related U.S. Application Data

(60) Provisional application No. 60/442,448, filed on Jan. 24, 2003.

(51) Int. Cl.
*E06B 7/08* (2006.01)

(52) U.S. Cl. ..... 49/74.1; 49/87.1; 49/403

(58) Field of Classification Search ..... 49/74.1, 49/87.1, 403; 52/473; 454/225

See application file for complete search history.

(56) References Cited

U.S. PATENT DOCUMENTS

| | | | | | |
|---|---|---|---|---|---|
| 213,343 | A | * | 3/1879 | Morstatt | 49/87.1 |
| 291,924 | A | * | 1/1884 | Morstatt | 49/87.1 |
| 421,047 | A | * | 2/1890 | Hantsche | 49/82.1 |
| 546,845 | A | * | 9/1895 | Fuller | 49/87.1 |
| 2,166,441 | A | * | 7/1939 | Jones | 49/82.1 |
| 5,216,837 | A | | 6/1993 | Cleaver et al. | |
| 5,471,789 | A | * | 12/1995 | Faircloth | 49/74.1 |
| 5,537,780 | A | | 7/1996 | Cleaver et al. | |
| 5,598,664 | A | * | 2/1997 | Grice | 49/74.1 |
| 6,128,857 | A | | 10/2000 | Morgan et al. | |
| 2003/0015300 | A1 | | 1/2003 | Colson et al. | |

* cited by examiner

*Primary Examiner*—Jerry Redman
(74) *Attorney, Agent, or Firm*—Dann, Dorfman, Herrell and Skillman; Henry H. Skillman

(57) ABSTRACT

A louver assembly includes a frame that forms a frame opening. The frame has a front face and a hollow recess in the front face. A series of parallel slats are mounted in the frame opening. The slats are pivotally displaceable between an open position and a closed position. An actuator connected with the slats is displaceable relative to the frame to pivot the slats between the open position and the closed position. The actuator may be inserted into the recess substantially flush with the front face of the frame when the slats are pivoted to the closed position.

9 Claims, 5 Drawing Sheets

SHUTTER BLIND

RELATED APPLICATIONS

Pursuant to 35 U.S.C. § 119, this application claims the benefit of the filing date of U.S. Provisional Application No. 60/442,448, filed Jan. 24, 2003, the entire disclosure of which is incorporated herein by reference.

FIELD OF THE INVENTION

This invention relates generally to louvers with slats that pivot by operation of an actuator, and more specifically to louvers and blinds with slats that open and close by operation of an actuator that fits into the face of the blind.

BACKGROUND OF THE INVENTION

A variety of shutter blinds and louvers are presently available with slats that open and close. The slats may be interconnected with a variety of mechanisms that permit the slats to be opened and closed. Some blinds feature an external adjustment mechanism, such as a pivot bar, to open and close the slats. The adjustment mechanism is usually connected to each of the slats with staples, clips or other fasteners that are visible on the blind. In addition, the adjustment mechanism typically hangs over the slats when the slats are opened and closed. The adjustment mechanism and fasteners detract from the appearance of the blind and obstruct the view through the blind when the slats are open.

In some blinds, the external adjustment mechanism extends freely in front of the blind with no retention means to hold or lock the adjustment mechanism in place. If the blind or the adjustment mechanism is subject to vibration or bumped by incidental contact, the slats can easily move out of position. This can be undesirable where the user desires the blind to remain fully open or fully closed.

Many shutter blinds avoid the use of an external adjustment mechanism and instead utilize a complex internal adjustment mechanism having components on the interior of the blind. Since the adjustment mechanism is located inside the blind, the slats are opened and closed by grasping and pivoting the slats directly. Although blinds in this category avoid using an external pivot bar, the internal mechanism is costly to manufacture and difficult to repair. Based on the foregoing, shutter blinds in the present state of the art leave much to be desired in terms of operation and appearance.

SUMMARY OF THE INVENTION

With the foregoing in mind, a louver assembly in accordance with the present invention includes a frame that forms a frame opening. The frame has a front face and a hollow recess in the front face. A series of parallel slats are mounted in the frame opening. The slats are pivotally displaceable between an open position and a closed position. An actuator connected with the slats is displaceable relative to the frame to pivot the slats between the open position and the closed position. The actuator may be inserted into the recess substantially flush with the front face of the frame when the slats are pivoted to the closed position.

In one embodiment, the invention includes a blind having a plurality of parallel slats pivotally mounted between a first stile and a second stile. An actuator, which is connected to the slats, is displaceable between a first position, in which the slats are pivoted to a closed position, and a second position, in which the slats are pivoted to an open position.

A recess formed in the first stile is adapted to receive and substantially conceal the actuator in a position flush with the exterior of the first stile. The actuator may be formed with an interior edge having a first non-linear contour, and the recess may be formed with a surface having a second non-linear contour that is complementary to the first non-linear contour of the interior edge of the actuator.

The invention may include a series of parallel slats with diamond shaped cross sections and rounded ends. The cross section of each slat may have a first face that tapers toward the rounded ends at a first taper angle, and a second face that tapers toward the rounded ends at a second taper angle. The first and second taper angles permit the slats to overlap and engage one another when the slats are in the closed position. Depending on the size and position of the slats, the first taper angle may be greater than the second taper angle to increase the overlap between slats and decrease the amount of light and air that passes through the closed slats.

The louver may include a base, a plurality of parallel slats connected with the base, and an actuator lever. The lever may be connected with the slats by a plurality of slide pins. In addition, the slats may be connected with the base by a plurality of pivot pins that extend from the base. The lever is displaceable between an extended position in which the slats are disposed in a non-overlapping arrangement, and a collapsed position in which the slats are disposed in an overlapping arrangement.

The louver assembly may also include a lock mechanism to secure the slats in place when the slats are closed. The louver may include a frame and an actuator that engages with the frame to secure the slats in the closed position. More specifically, the actuator may engage with a recess in the frame that receives the actuator and releasably retains the actuator in a locked position to retain the slats in the closed position.

The louver assembly may be configured for use in a variety of wall openings. For example, the louver assembly may include a frame forming a rectangular frame opening. Alternatively, the louver assembly may include a frame forming a semi-circular frame opening.

BRIEF DESCRIPTION OF THE DRAWINGS

The foregoing summary and the following description of the invention will be better understood when read in conjunction with the drawing figures, in which.

DESCRIPTION OF THE INVENTION

Figure 1:
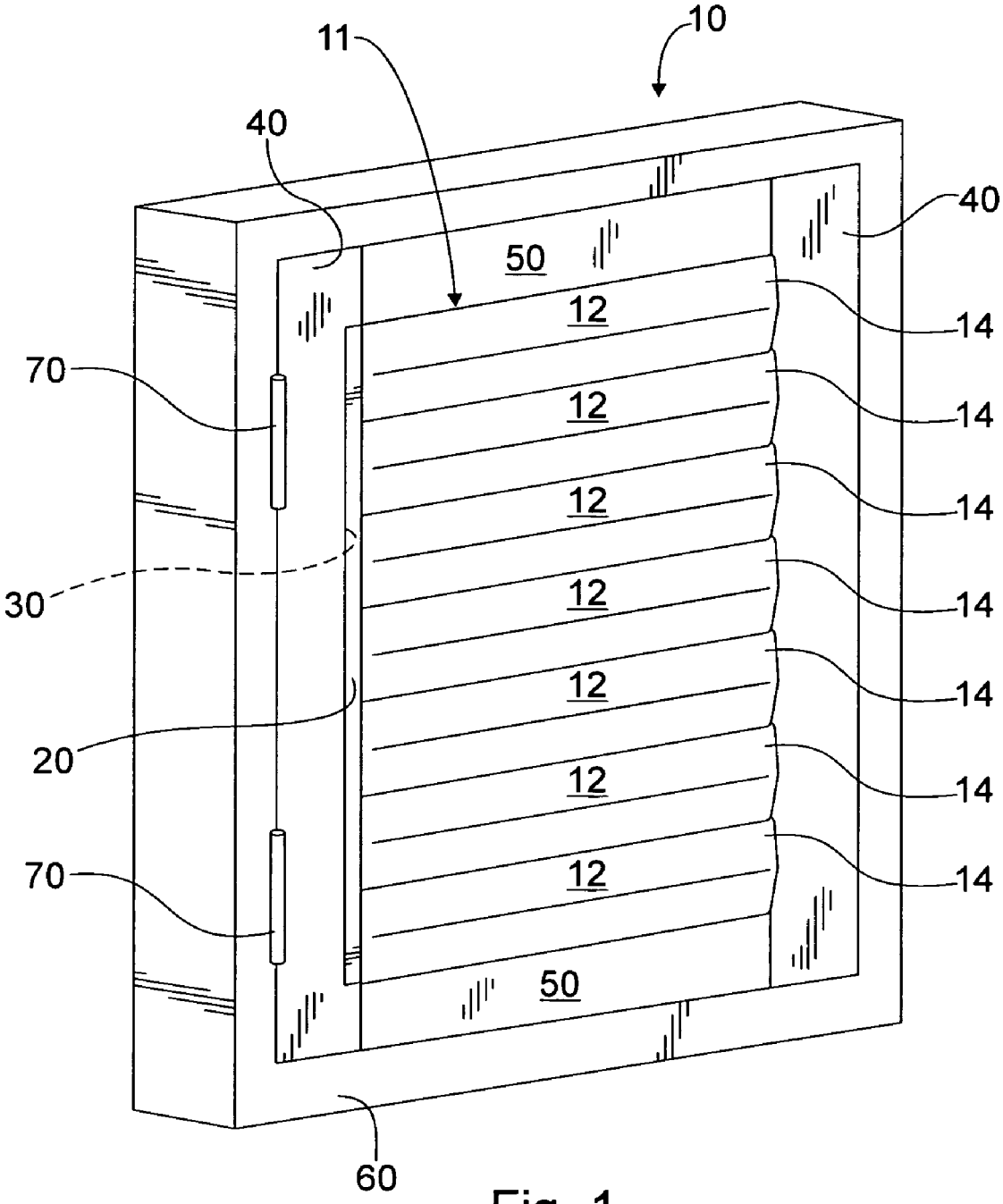
FIG. 1 is a perspective view of a blind in accordance with the present invention, wherein the blind has a series of slats in a closed position.
Figure 2:
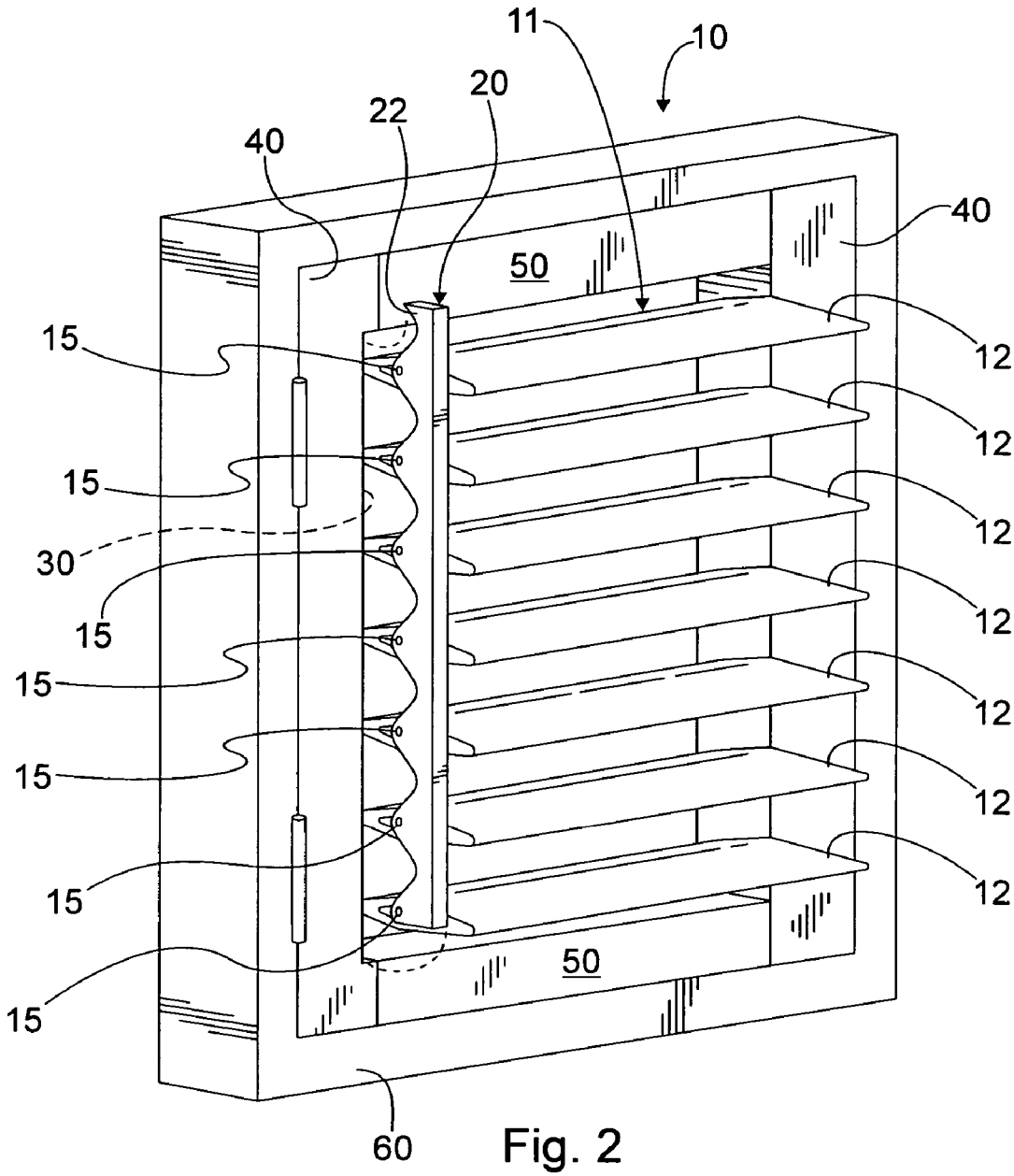
FIG. 2 is a perspective view of the blind of FIG. 1, wherein the slats of the blind are pivoted to an open position.

Referring to the drawing figures generally, and FIGS. 1–2 in particular, a shutter blind in accordance with the present invention is shown and designated generally as 10. The shutter blind 10 has a louver 11 with a series of movable slats 12. The orientation of each slat 12 is adjustable by an actuator or lever 20 extending along one side of the blind 10. The actuator 20 is connected with the slats 12 in a pivoting arrangement which permits positional adjustment of the all the slats in unison.

The slats 12 are pivotable between a closed position, in which the slats substantially block the passage of light and air through the louver 11, and an open position, in which the slats permit the passage of light and air through the louver. FIG. 1 shows the slats 12 pivoted to the closed position, and FIG. 2 shows the slats pivoted to the open position. The orientations of the slats are controlled by the position of the actuator 20 relative to the blind 10. Specifically, the actuator 20 is displaceable outwardly from the blind 10 to pivot the slats 12 to the open position. The actuator 20 is also displaceable inwardly toward the blind 10 to pivot the slats 12 to the closed position. The actuator 20 and slats 12 are connected in a pivoting arrangement that permits stepless adjustment of the slats through a continuous range of positions. As such, the slats are adjustable in a wide range of intermediate positions between the open and closed positions.

The shutter blind 10 in FIG. 1 is a single hung window blind with horizontal slats that can be mounted inside a window casing. The present invention is not limited to single hung window blinds however, and may be used with a variety of blinds, louvers or screens featuring horizontal or vertical slats. For example, the present invention may be used as a louver mounted in the exterior wall of an attic, crawl space or shed, having pivoting slats that can be pitched at a downward angle that admits air into an interior space while shedding rain away from the wall opening.

The blind 10 may be constructed with a variety of components to support the louver 11 and actuator 20, and the particular frame design is not germane to the invention. In FIGS. 1–2, the slats 12 on the blind 10 are shown mounted between a pair of stiles or rails 40. The stiles 40 extend generally transversely to the orientation of the slats 12. A pair of end blocks 50 extend generally parallel to the orientation of the slats 12 and connect the stiles 40 with one another. The stiles 40 and end blocks 50 may be connected with adhesive, fasteners or other connecting means. The slats 12, stiles 40 and end blocks 50 may be formed of wood, polyvinyl, medium density fiberboard, or a combination of synthetic materials. Where synthetic materials are used, the stiles 40, slats 12 and end blocks 50 may be formed by an extrusion process, molding or other method. Other frame configurations may be used, and the blind need not be constructed with stiles and end blocks. For example, the louver 11 and actuator 20 may be mounted in a one-piece molded polyvinyl frame. This would reduce the number of parts required to assemble the blind, in comparison to a frame having stiles and end blocks.

Figure 3:
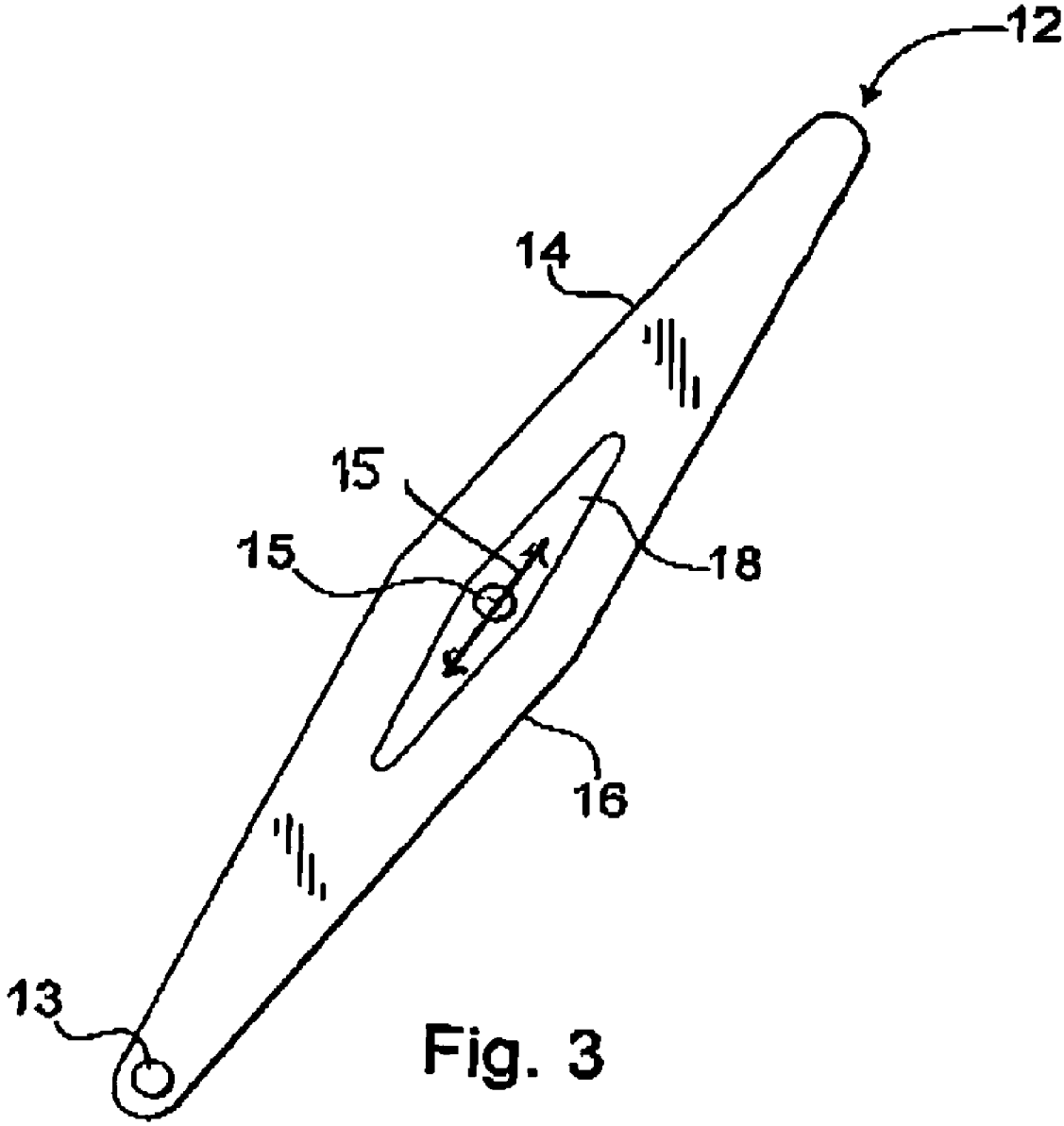
FIG. 3 is an enlarged side elevation view of a slat used in the blind of FIG. 1.

The shutter blind 10 will now be described in more detail. Referring to FIG. 3, each slat 12 has a narrow diamond-shaped cross section with a pair of rounded edges. The slats 12 are configured to overlap adjacent slats when the slats are closed. The cross section of each slat 12 has a broad center section having a thickness that tapers to a narrower thickness toward the ends. The slats 12 each have a first face 14 forming a V-shaped crest generally located at the center of the first face. The slats 12 also have a second face 16 forming a V-shaped crest generally located at the center of the second face. In FIG. 1, the first face 14 on each slat 12 is oriented toward the front side of the blind 10.

In the preferred embodiment of the invention, the slats 12 are contoured to overlap and engage one another when the slats are in the closed position so as to minimize the amount of light that passes through the closed slats. To minimize light penetration, the taper angle forming the crest on the first face 14 of the slats 12 is preferably greater that the taper angle forming the crest on the second face 16 of the slats. In this configuration, the overlapping surfaces on the first and second faces of the slats 12 converge in tight engagement, minimizing gaps and seams that allow light to filter through the closed slats.

Figure 4:
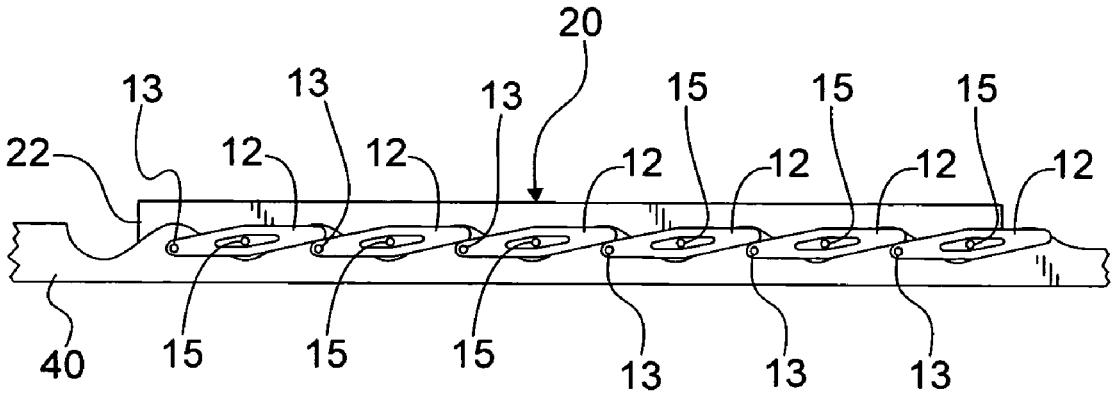
FIG. 4 is a fragmented side elevation view of the actuator and louver assembly used in the blind of FIG. 1, wherein the slats of the blind are pivoted to a closed position.
Figure 5:
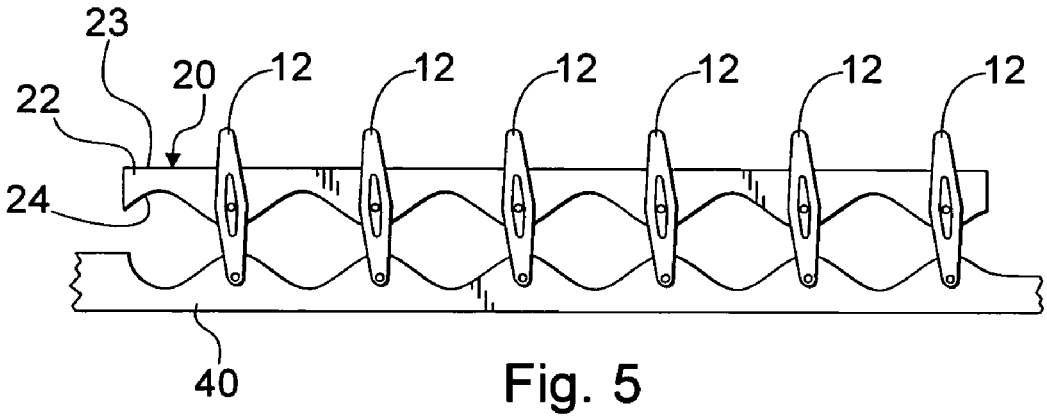
FIG. 5 is a fragmented side elevation view of the actuator and louver assembly used in the blind of FIG. 1, wherein the slats of the blind are pivoted to an open position.

Referring now to FIGS. 4–5, the slats 12 are supported between the stiles 40 by pivoting connectors. The slats may be supported using a variety of pivoting connectors. For example, the slats 12 may each be supported on a rod mounted between the stiles 40 that extends through a bore formed through the interior of each slat 12. Alternatively, each slat 12 may be supported by a pin connection on both ends of the slat that connects the slat with the stiles 40. In FIGS. 4–5, the slats are supported on the stiles 40 by a plurality of pivot pins 13. Each pivot pin 13 has a first end extending into a bore hole in one of the stiles 40, and a second end inserted into a bore hole in one of the slats. The pins 13 that support the slats 12 are preferably formed of a hard durable material. The pins 13 may be inserted directly into the slats and stiles. Alternatively, the pins 13 may be mounted through washers and inserted into bushings mounted in the bores to protect surfaces that contact and slide against one another when the slats are opened and closed.

The bore holes in the stiles and slats (or bushing holes if bushings are used) preferably have hole diameters that are substantially equal to the diameter of the pivot pins 13. In this configuration, the pivot pins frictionally engage the walls in the holes. The frictional engagement between the pivot pins and bore holes (or bushing holes) is operable to hold the slats in the open position and retain the actuation bar 22 in a raised position against the force of gravity after the actuation bar is raised and released. More specifically, the frictional engagement resists the downward pull on the slats which arises from gravitational pull on the actuation bar and slats. In this arrangement, the bar 22 may be raised to any position and released, leaving the slats in a fully open position or partially open position. The pivot pins 13 may be inserted into the slats and stiles using a number of techniques to establish frictional engagement, such as by press fitting the pivot pins into the slats and stiles.

The blind 10 has a recess 30 that receives the actuator 20 when the actuator is displaced inwardly toward the blind to close the slats 12. The actuator 20 fits into the interior of the recess 30 and conforms with the front face of the blind 10 to visually blend with the exterior of the blind 10. In this arrangement, the actuator 20 does not significantly detract from the appearance of the blind 10 because the actuator is integrated into the facade of the blind. The actuator 20 may have a variety of shapes and contours to blend visually with the exterior of the blind. For example, the actuator 20 may include a narrow elongated bar 22 that fits into the blind 10 along one side of the louver 11, as shown in FIG. 2. The elongated bar 22 has a first side 23 that faces outwardly and is exposed on the front side of the blind 10. The elongated bar 22 also has a second side 24 that faces inwardly toward the recess 30. In the preferred embodiment, the height and width dimensions of the bar 22 are substantially equal to, or slightly less than the height and width dimensions of the recess. A limited tolerance between the elongated bar 22 and walls of the recess limits the potential for the bar to shift in the recess. In addition, the gaps and spaces around the perimeter of the bar 22 are less noticeable from the outside of the blind, contributing to a seamless appearance around the bar.

The actuator preferably has a locking mechanism to securely hold or lock the slats in the closed position. In this arrangement, the lock limits incidental movement of the slats which could open the blind when the blind is subject to vibrations, drafts or incidental contact with other objects. A variety of locking mechanisms may be used. Referring to FIGS. 1–3, the locking arrangement is provided by the elongated bar 22 and recess 30. The second side 24 of the elongated bar 22 engages an interior surface in the recess 30 to limit the extent in which the bar can move within the recess. The interior surface in the recess and the second side 24 of the bar 22 engage one another to limit how far the bar can be inserted into the recess. The second side 24 of the bar 22 has a non-linear profile, and the interior surface in the recess has a corresponding non-linear surface that conforms with the non-linear profile on the second side of the bar. The second side 24 of elongated bar 22 is configured to mate with the interior of the recess 30 in a snug fit that prevents the bar from shifting and sliding in the recess.

The second side 24 of the bar 22 may have any non-linear geometry to secure the bar in the recess 30. In FIGS. 2, 4 and 5, the actuation bar 22 has a serpentine edge. The recess 30 has a serpentine surface that mates with the serpentine edge on the second side of the actuation bar 22 when the bar is positioned in the recess 30. The bar 22 and recess 30 may alternatively have other non-linear surface contours, such as scalloped edges, "saw-tooth" edges or jagged edges that mesh with one another when the bar is positioned in the recess.

The locking arrangement may also be provided by frictional contact between the actuator bar and sidewalls in the recess. In particular, one or more edges of the actuator bar may be configured to slide against and frictionally engage one or more sidewalls in the recess when the actuator bar is inserted into the recess. In the blind 10 shown in FIG. 2, the recess 30 is formed along the inside edge of the stile 40 on the left side of the blind 10. In this arrangement, the recess has a top sidewall, a left sidewall, and a bottom sidewall, and the actuation bar 22 has a corresponding top edge, left edge and bottom edge. The top edge, left edge and bottom edge of the actuation bar 22 are configured to slide against and frictionally engage the top, left and bottom sidewalls of the recess. The contact between the actuation bar 22 and the sidewalls of recess 30 provides frictional resistance that substantially prevents movement of the actuation bar relative to the blind after the actuation bar is inserted into the recess. The frictional resistance stabilizes the position of the bar and slats until the user deliberately moves the bar out of the recess.

The actuation bar and recess are preferably formed by cutting out a section of the frame piece that surrounds the louver 11. In the blind shown in FIGS. 1–2, for example, the actuation bar 22 would preferably be cut out of the stile 40 appearing on the left side of the drawing. The cut out section forms the actuation bar 22, and the void left in the stile 40 forms the recess 30. By cutting the actuation bar 22 out of the stile 40, the actuation bar 22 and recess 30 can be formed in a single step, with the height and width dimensions of the bar 22 being substantially equal to the height and width dimensions of the recess. As mentioned above, a limited tolerance between the elongated bar 22 and walls of the recess limits the potential for the bar to shift in the recess and improves the appearance of the front of the blind. The actuation bar 22 and adjacent stile 40 may also be formed from separate pieces of material, if desired.

The actuation bar 22 is displaceable in a generally vertical plane to pivot the slats 12 between the open position and the closed position. In FIG. 4, the slats 12 are shown in the closed position. In FIG. 5, the slats 12 are shown in the open position. The actuation bar 22 may be connected to the slats 12 in a variety of configurations. In FIGS. 4–5, the actuation bar 22 is connected to the slats 12 by a series of sliding pins 15. Each sliding pin 15 comprises a first end connected with the actuation bar 22, and a second end connected with a slat 12. The first end of each sliding pin 15 is configured for insertion into a bore bole in a side of the actuation bar 22. The second end of each sliding pin 15 is configured for insertion in an elongated slot 18 in the side of a slat 12. The sliding pins 15 are configured to slidably engage the walls of the elongated slots 18 as the actuation bar 22 is operated. More specifically, the sliding pins 15 are configured to slide along the slots 18 between the opposite ends of the slots, as indicated by the arrow 15' in FIG. 3, as the slats pivot between the open and closed positions. In this arrangement, the slats 12 operate like linkages between the actuation bar 22 and the stile 40 adjacent to the actuation bar. The sliding pins 15 are preferably formed of a hard durable material with a low coefficient of friction, such as stainless steel.

As stated earlier, the second side of the actuation bar 22 and the corresponding surface in the recess 30 preferably have non-linear surfaces, such as serpentine edges or other non-linear configurations. The non-linear surfaces on the bar 22 and in the recess 30 permit the sliding pins 15 to be positioned in substantial alignment with the pin connections 13 (or rods if rods are used) when the slats are pivoted to the closed position. The substantial alignment of the pins 13, 15 are best shown in FIG. 4. This alignment allows the slats to close tightly in a substantially flat and compact arrangement, which may be advantageous where a flattened shutter appearance is desired.

Thus far, the actuation bar has been described as projecting from the front face of the blind 10. If the blind 10 is mounted in a room over a window, the actuation bar 22 would be visible from the interior of the room when the actuation bar is moved outwardly to open the slats 12. It may be desirable to install the blind 10 so that the actuation bar 22 is concealed behind the blind and faces into the window opening. In this concealed position, the actuation bar 22 is not accessible from inside the room to adjust the slats 12. Nevertheless, the slats 12 can be adjusted by grasping one of the slats and pivoting the slat. Since all the slats 12 are interconnected with one another via the actuation bar, the pivoting of one slat is operable to displace all the slats in unison. Alternatively, one or more slats 12 may be fitted with a small handle or tab that can be grasped so that the slats are not handled directly.

In FIGS. 1–2, the blind 10 is shown with a rectangular frame 60 that extends around the stiles 40 and end blocks 50. The frame 60 is configured for mounting the louver 11 in a window casing or a wall section surrounding a window opening. A pair of hinges 70 are attached to one of the stiles 40 to pivotally connect the louver 11 to the interior of the frame. The hinges 70 permit the louver 11 to swing outwardly from the frame 60. Alternatively, the louver 11 may be mounted directly in a window opening and attached to the inner sides of the window casing without the frame 60. One or more hinges may be attached to the interior of the window casing and connected to one of the stiles 40 to pivotally mount the blind 10 inside the window casing.

The present invention and its components may be manufactured and sold in separate parts. For example, the stiles 40, actuation bar 22, slats 12, rectangular frame 60, pins 13, 15 and/or rods can be sold as individual parts and combined as needed to construct a new blind or repair an existing blind. Alternatively, the blind and its components may be manufactured and sold as prefabricated units or in kits requiring assembly. In addition to the prefabricated units or kits, other components may sold as optional accessories, such as the rectangular frame 60.

Figure 6:
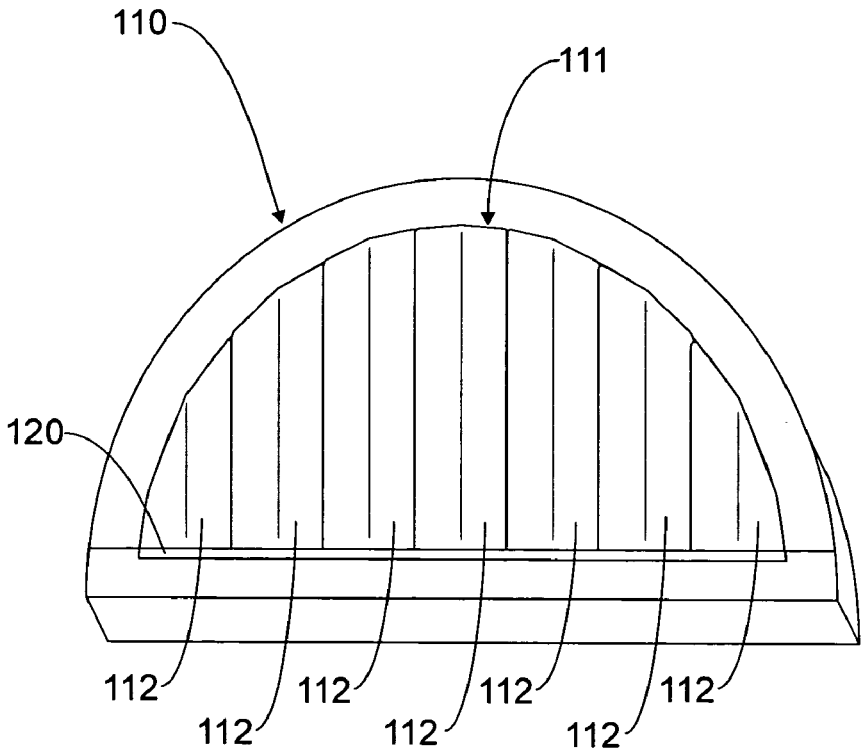
FIG. 6 is a perspective view of an alternate embodiment of a blind in accordance with the present invention, wherein the blind has a series of slats in a closed position.
Figure 7:
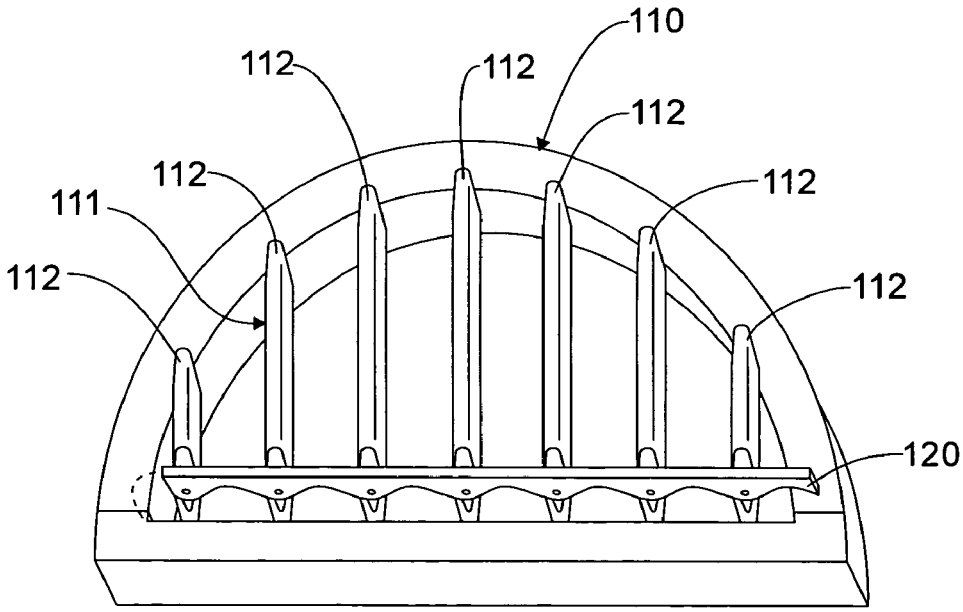
FIG. 7 is a perspective view of the blind of FIG. 6, wherein the slats of the blind are pivoted to an open position.

Thus far, the present invention has been shown and described with a rectangular shaped louver. The present invention can be used with louvers having a variety of shapes, however, and the components of the invention are not limited to rectangular louver installations. Referring to FIGS. 6–7, an alternative embodiment 110 is shown with a louver 111 that can be installed in a semi-circular shaped opening. Louver 111 has a series of parallel vertical slats 112 that are pivotally mounted to an actuation bar 120. The actuation bar 120 is operable to pivot the slats 112 between a closed position, in which the slats substantially block the passage of light and air through the louver 111, and an open position, in which the slats permit passage of light and air through the louver. The slats 112 are shaped to conform to the semi-circular opening when the slats are pivoted closed.

The terms and expressions which have been employed are used as terms of description and not of limitation. There is no intention in the use of such terms and expressions of excluding any equivalents of the features shown and described or portions thereof. It is recognized, therefore, that various modifications are possible within the scope and spirit of the invention. Accordingly, the invention incorporates variations that fall within the scope of the following claims.

I claim:

1. A blind comprising: plurality of parallel slats pivotally mounted between a first stile and a second stile;

an actuator connected to the slats and displaceable between a first position, in which the slats are disposed in a closed position, and a second position, in which the slats are disposed in an open position; and a recess formed in the first stile, said recess being adapted to receive the actuator so that the actuator rests flush with the exterior of the first stile, each slat having a generally diamond shaped cross section, and an elongated slot extending along its longitudinal centerline, said actuator having pins slidable in said slots to displace said slats between said open and closed positions.

2. The blind of claim 1, wherein the actuator comprises an interior edge having a first non-linear contour, and the recess comprises a surface having a second non-linear contour that is complementary to the first non-linear contour of the interior edge of the actuator.

3. The blind of claim 1, wherein said generally diamond shaped cross section has rounded ends, and a cross section formed by a first longitudinal face that tapers toward the rounded ends at a first taper angle, and a second longitudinal face that tapers toward the rounded ends at a second taper angle, said first taper angle being greater than the second taper angle.

4. The blind of claim 1 wherein the recess forms a rectangular opening comprising three sidewalls, and the actuator comprises a rectangular bar having dimensions substantially equal to the dimensions of the rectangular opening, said actuator bar being configured to engage the sidewalls of the rectangular opening to visually blend with the first stile.

5. A louver having slats displaceable between an extended position in which the slats are disposed in a non-overlapping arrangement, and a collapsed position in which the slats are disposed in an overlapping arrangement, comprising:

A. a base forming a non-linear first edge;

B. a lever forming a non-linear second edge configured to nest with the first edge on the base, said second edge being complementary to said first edge;

C. said slats each comprising an elongated slot extending along the longitudinal centerline of the slat;

D. a plurality of slide pins extending from the lever into the elongated slots in said slats to connect the slats with said lever; and E. a plurality of pivot pins extending from the base, each of said pivot pins connecting with one of said slats, the slide pin and the pivot pin for each slat forming a pair, said slot enabling the distance between the pins in the pair to change as the the lever is displaced and allow said complementary edges to nest in the collapsed position.

6. The louver of claim 5, wherein the pivot pins are arranged proximally to the first edge of the base and the slide pins are arranged proximally to the second edge on the lever so that the pivot pins are substantially aligned with the slide pins when the lever is disposed in the collapsed position.

7. A louver assembly comprising:

A. a frame forming a frame opening and comprising a front face having a hollow recess;

B. a series of parallel slats mounted in the frame opening, said slats being pivotally displaceable between en open position and a closed position and having an elongated slat alone the longitudinal center line of the slat;

C. an actuator having slide pins engaging the slats in the slats and displaceable relative to the frame to pivot the slats in unison between the open position and the closed position, and D. a lock mechanism on the frame, operable to secure slats in the closed position, said lock mechanism including non-linear edge on the actuator and a complementary non-linear surface in the recess that frictionally engages with the non-linear edge on the actuator, so that the actuator nests in the lock mechanism, wherein the actuator is configured for insertion Into the recess substantially flush with the front face of the frame when the slats are pivoted to the closed position.

8. The louver assembly of claim 7, wherein the frame forms a rectangular frame opening.

9. The louver assembly of claim 7, wherein the frame forms a semi-circular frame opening.

* * * * *

UNITED STATES PATENT AND TRADEMARK OFFICE

CERTIFICATE OF CORRECTION

PATENT NO. : 7,082,719 B2
APPLICATION NO. : 10/760912
DATED : August 1, 2006
INVENTOR(S) : Fred Regnery It is certified that error appears in the above-identified patent and that said Letters Patent is hereby corrected as shown below:

In the Drawings

Fig. 3 should be as follows:

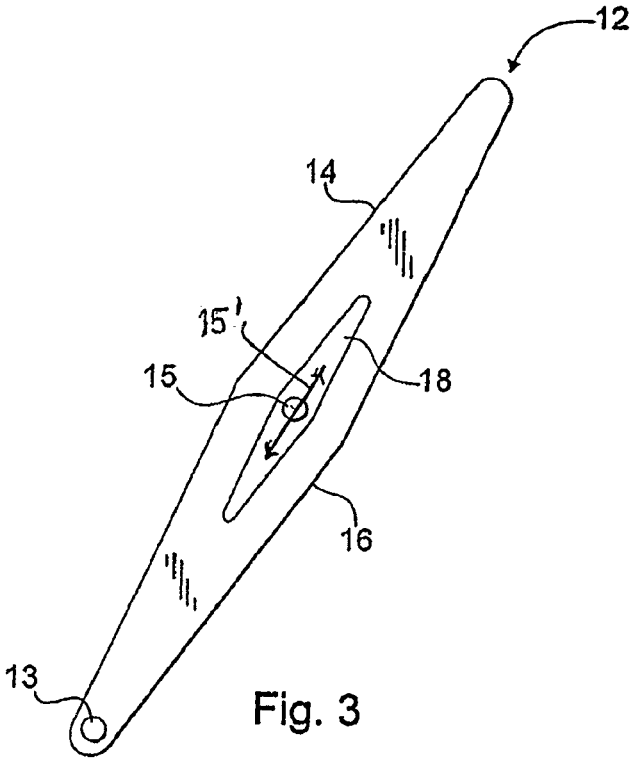

Fig. 3

Signed and Sealed this

Twenty-fourth Day of October, 2006

JON W. DUDAS
*Director of the United States Patent and Trademark Office*